US006666165B2

(12) United States Patent
Shiraishi et al.

(10) Patent No.: US 6,666,165 B2
(45) Date of Patent: Dec. 23, 2003

(54) CURTAIN COATING APPARATUS AND CURTAIN COATING PROCESS

(75) Inventors: Masato Shiraishi, Tokyo (JP); Kazutoshi Someya, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 72 days.

(21) Appl. No.: 10/105,288

(22) Filed: Mar. 26, 2002

(65) Prior Publication Data

US 2003/0039761 A1 Feb. 27, 2003

(30) Foreign Application Priority Data

Mar. 29, 2001 (JP) ..... 2001-094993
Jan. 21, 2002 (JP) ..... 2002-011780

(51) Int. Cl.[7] ..... B05D 1/00

(52) U.S. Cl. ..... 118/325; 118/DIG. 4; 118/62; 118/302

(58) Field of Search ..... 118/325, DIG. 4, 118/410, 413, 419, 58, 63, 68, 302, 420, 62; 427/420, 421

(56) References Cited

U.S. PATENT DOCUMENTS 4,324,820 A * 4/1982 Weldon ..... 118/DIG. 4
5,976,630 A * 11/1999 Korokeyi et al. ..... 118/DIG. 4
6,146,690 A * 11/2000 Kustermann ..... 118/DIG. 4
6,387,455 B1 * 5/2002 Katagiri et al. ..... 118/DIG. 4

FOREIGN PATENT DOCUMENTS

| | | | |
|---|---|---|---|
| DE | 3701406 | C2 | 7/1988 |
| DE | 19903559 | A1 | 10/1999 |
| DE | 19829449 | A1 | 1/2000 |
| JP | 11-300256 | A | 11/1999 |

OTHER PUBLICATIONS

European Office Action.

* cited by examiner

*Primary Examiner*—Richard Crispino
*Assistant Examiner*—Yewebdar T Tadesse
(74) *Attorney, Agent, or Firm*—Armstrong, Kratz, Quintos, Hanson & Brooks, LLP

(57) ABSTRACT

A curtain coating apparatus for applying a coating solution to a continuously moving web, which comprises an air jet injector for injecting air in the upstream direction of a web, provided at a position upstream of a contact point of a curtain film with the web and a shielding member shutting off entrained air generated by movement of the web, provided between the contact point and the air jet injector, thereby diminishing an influence of turbulent air flow and preventing the curtain film from suction toward the air jet injector.

12 Claims, 3 Drawing Sheets

CURTAIN COATING APPARATUS AND CURTAIN COATING PROCESS

BACKGROUND OF THE INVENTION

1) Field of the Invention

The present invention relates to a curtain coating apparatus and curtain coating process for producing coated products of a good quality such as printing sheets, pressure-sensitive recording sheets, heat-sensitive recording sheets, photographic sheets, printing process materials, etc. by eliminating entrained air about a continuously moving web such as paper sheets, paper sheets to be coated, films etc. at a high speed coating, thereby stabilizing the curtain film.

2) Related Art Statement

Curtain coating process is a process, which comprises forming a free falling liquid curtain film of at least one of coating solutions, and allowing the liquid curtain film to contact with a material to be coated (web), thereby forming a film on the web to be coated, and has been used for a long time as a process for surface-coating steel plates.

The curtain coating process has so far suffered from uncoated regions or coating unevenness during the formation of films on the web. One reason is a poor affinity of the web surface to the coating solution. In that case, such a problem has been solved by improving the affinity of the web to the coating solution by a physical or chemical means.

Another reason is a problem of entrained air around the web surface. The entrained air is generated on the high speed-moving web surface, and the coating solution is applied to the web surface without eliminating the entrained air from the web surface, thereby forming uncoated regions on the coated web surface or the entrained air turns to a turbulent air flow near the liquid curtain film to vibrate the liquid curtain film, thereby generating coating unevenness on the coated web surface. Such problems will be serious particularly at a higher coating speed, and thus it is the main reason why the coating speed cannot be increased in the curtain coating process.

In a slide hopper type curtain coating apparatus as a typical curtain coating apparatus for coating a photographic photo-sensitive material, the heel part on the coating line is attracted toward the web upstream side by evacuation at the coating point (contact point between the web and the coating solution), thereby stabilizing the coating, and also solvent vapor are generated at the same time as the evacuation or the entrained air is replaced with a gas easily soluble in the coating solution (e.g. carbon dioxide gas) as further supplementation means.

In an extrusion type curtain coating apparatus, on the other hand, it is possible to conduct coating in a high speed region than in the slide hopper type curtain coating apparatus, because the falling momentum of curtain film can break the entrained air zone. However, with increasing coating speed or to make the generation of product quality defects zero, many attempts have been made to eliminate the entrained air itself. Basically, it has been proposed to provide an air shield plate for shielding the curtain film from the entrained air at a position upstream of the curtain film. Since then, still further attempts have been made. A typical one is a method for withdrawing the entrained air at a position upstream of the curtain film by suction, but the entrained air newly generated in the high speed region cannot be fully shut off from the curtain film by such an entrained air-withdrawing method.

A method of contacting a web with a shield at a position by a few ten millimeters upstream of the curtain film (which will be hereinafter referred to as "contact type") has been also proposed as an effective means for fully shielding the curtain film from the entrained air. The contact type is an ultimate method for shielding the curtain film from the entrained air, because it physically shields the curtain film from the entrained air by means of a solid shield, and it has been indeed difficult and not efficient to shield the curtain film from the entrained air by other methods better than by the contact type.

Contact type curtain coating apparatus will be described in detail below, referring to FIG. 5, which is a schematic view of a conventional curtain coating apparatus, where shield member 21 is provided at a position upstream of and near coater head 1. Web contact member 22 is provided at the lower end of shield member 21 and is brought into contact with web 10 during the movement of web 10. Air entrained by high speed movement of web 10 is shut off from curtain film 6 by web contact member 22, thereby giving no influence on curtain film 6 at the downstream position.

However, in the contact type the shield is in contact with the web, so that such various problems are often encountered as paper powdering or scuffing in case of paper webs, etc., powder falling due to peeling and falling of coating composition in case of coated paper sheets, etc., scratches on the web surface in case of films, etc. Even simple contact with the shielding member has brought about such a problem as wear of the shielding member at an increasing coating speed and has been found not suitable for production-level operation for a long time. Multifunctional paper sheets often undergo multi-layer coating and a contact type-modified wet-on-wet coating method suffers from scraping of the coating solutions applied at the upstream positions also together with the entrained air and thus is not practical.

As mentioned above, a contact type method has been found highly effective as a method for shielding the curtain film from the air entrained around the moving web in a curtain coating apparatus for applying a coating solution to a continuously moving web, but it has been difficult to stably produce coated products without causing various problems such as paper powdering, scuffing, powder falling, scratching of web surfaces, wearing of shielding members, etc.

SUMMARY OF THE INVENTION

An object of the present invention is to provide a curtain coating apparatus and a curtain coating process capable of producing coated products of a good quality by eliminating an entrained air around a web at high speed coating, thereby stabilizing a curtain film.

As a result of extensive studies of the aforementioned problems, the present inventors have succeeded in establishing novel and efficient curtain coating apparatus and curtain coating process of the present invention.

A first aspect of the present invention provides a curtain coating apparatus for applying a coating solution to a continuously moving web, which comprises an air jet injector for injecting air in the upstream direction of a web, provided at a position upstream of a contact point of a curtain film with the web and a shielding member for shutting off entrained air generated by movement of the web, provided between the contact point and the air jet injector, thereby eliminating an influence of turbulent air flow and preventing the curtain film from suction toward the air jet injector.

A second aspect of the present invention provides a curtain coating apparatus for applying a coating solution to a continuously moving web, which comprises an air jet injector for injecting air in the upstream direction of a web, provided at a position upstream of a contact point of a curtain film with the web, a shielding member for shutting off entrained air generated by movement of the web, provided between the contact point and the air jet injector, thereby eliminating an influence of turbulent air flow and preventing the curtain film from suction toward the air jet injector, and a control member connected to the shielding member, the control member being provided at a position near and in parallel to the web, thereby preventing the entrained air from regrowth in the course between the air jet injector and the contact point.

A third aspect of the present invention provides a curtain coating apparatus for applying a coating solution to a continuously moving web, which comprises an air jet injector for injecting air in the upstream directions of a web, provided at a position upstream of a contact point of a curtain film with the web, a shielding member for shutting off entrained air generated by movement of the web, provided between the contact point and the air jet injector, a control member and a partition wall member, both of which are integrated with the shielding member to form a closed space, the air jet injector and an air suction means being provided in the closed space, thereby making the closed space a subatmospheric pressure zone.

A fourth aspect of the present invention provides a curtain coating apparatus for applying a coating solution to a continuously moving web, which comprises an air jet injector for injecting air in the upstream direction of a web, provided at a position upstream of a contact point of a curtain film with the web, the air jet injector being provided with an air injection pipe with air injection nozzles for shutting off entrained air generated by movement of the web, thereby eliminating an influence of tabulent air flow and preventing the curtain film from suction toward the air jet injector, and a partition wall member covering a distance upstream of a coater head, which extends from a position at the top of the air injection pipe with the air injection nozzles to a position near the web moving direction-shifting sector of a roll from the vertical direction to the horizontal direction, thereby making the partition wall member-enclosed zone a closed space, the air jet injector and an air suction means being provided in the closed space, thereby making the closed space a subatmospheric pressure zone.

In the third or fourth aspect of the present invention, it is preferable that the air jet injector is connected to the air suction means to send the air sucked up by the air suction means to the air jet injector as an air feed source.

In the first to fourth aspects of the present invention, the air jet injector of the curtain coating apparatus for applying a coating solution to a continuously moving web comprises an air injection pipe having a length equal to or more than the width of the web, and one end or both ends of the air injection pipe is connected to a feed pipe of an air feed pump, and the air injection pipe is provided with air injection nozzles for injecting the air at predetermined distances in the lateral direction of the web.

In the foregoing first to fourth aspects of the present invention, the air injection nozzles of the air injection pipe are provided at distances of 5–20 mm in the lateral direction of the web.

It is preferable that the air injection nozzles have a nozzle diameter of 1–3 mm. Furthermore, it is preferable that the air injection nozzles are in a circular or elliptical shape.

In the curtain coating apparatus according to the foregoing first to fourth aspects of the present invention, steam or mists is injected from the air jet injector in place of air.

A curtain coating process using a curtain coating apparatus for applying a coating solution to a continuously moving web according to the first to fourth aspects of the present invention, which comprises applying a coating solution to a web by an air jet injector provided at a position upstream of a contact point of a curtain film with the web and in an upstream direction, while maintaining a distance between the bottom side of an air injection pipe provided at the air jet injector and the continuously moving web at not more than 6 mm.

In the foregoing curtain coating process using a curtain coating apparatus for applying a coating solution to a continuously moving web according to the first to fourth aspects of the present invention one of air, steam and mists is injected from air injection nozzles provided in an air injection pipe of the air jet injector provided at a position upstream of a contact point of a curtain film with the web and in an upstream direction at a nozzle angle of 30°–60° to the web.

Figure 1:
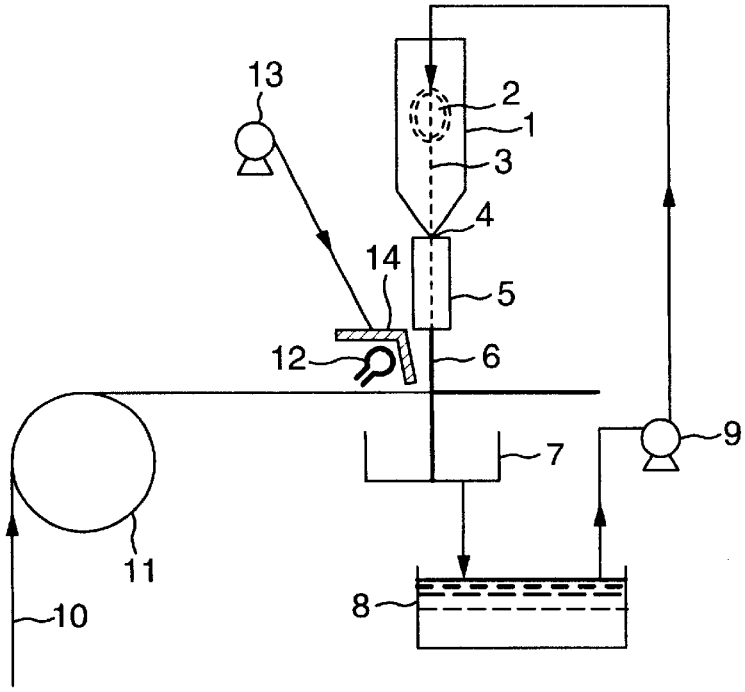
FIG. 1 is a schematic view showing one embodiment of a curtain coating apparatus according to a first aspect of the present invention.

In the drawings, numerals have the following meanings.

1: coater head, 2: manifold, 3: slit, 4: lip, 5: edge guide, 6: curtain film, 7: solution receptacle, 8: storage tank, 9: solution feed pump, 10: web, 11: roll, 12: air jet injector, 13: air feed pump, 14 and 21: shielding member, 15: control member, 16: air suction means, 17: air suction pump, 18: partition wall member, 19: subatmospheric pressure zone, 20: pressure gauge and 22: web contact member.

DETAILED DESCRIPTION OF THE INVENTION

The present invention will be described in detail below, referring to typical embodiments of the present invention on the basis of the drawings, but it should be understood that the present invention is not limited to the following typical embodiments and can be changed and modified within the spirit and the scope of the present invention.

FIG. 1 is a schematic view showing one embodiment of a curtain coating apparatus according to a first aspect of the present invention.

In FIG. 1, a coating solution prepared in advance and stored in storage tank 8 is fed to coater head 1 from storage tank 8 through solution feed pump 9. Coater head 1 comprises manifold 2 and slit 3, each finished in high precision, within the coater head. The fed coating solution is filled in manifold 2, and the pressure distribution in the lateral direction of web is made uniform through a narrow clearance through which the coating solution is passed to slit 3, while reducing the influence of dynamic pressure exerted by pumping action of solution feed pump 9. The coating solution falls down from lip 4 to form vertical curtain film 6.

Curtain film 6 made uniform in profile in the lateral direction is brought into contact with continuously moving web 10 to form a coating film on web 10. Edge guide 5 is provided with a width not larger than the width of coater head 1, but larger than the width of web 10, and thus curtain film 6 with a width larger than the width of web 10 can be formed. Why curtain film 6 with a width larger than that of web 10 is formed is to prevent curtain film 6 from possible thick coating at both edges thereof. Excess coating solution flowing over the width of web 10 is recovered into solution receptacle 7 and returned to storage tank 8; and is again fed to coater head 1 for application to web 10. Even in case that web 10 is ruptured for some reason to interrupt application, the coating solution is also recovered into solution receptacle 7.

To coat web 10 with the thus formed curtain film 6 in a stable state, some vertical distance is required for curtain film 6 between web 10 and the solution outlet at the bottom of coater head 1, but in the present embodiment the vertical distance of curtain film 6 can be controlled. Vertical distance suitable for stabilization of curtain film 6 is 60–300 mm, preferably 100–250 mm, more preferably 120–180 mm.

To eliminate the entrained air around the web, shielding member 14 is provided adjacent to coater head 1 and air jet injector 12 is further provided at a position upstream thereof. Air to air jet injector 12 is fed by air feed pump 13. Air jet injector 12 is set to inject air in the upstream direction. Entrained air around moving web 10 can be eliminated by the air injected by air jet injector 12, and further shut off by shielding member 14, thereby stabilizing the falling state of curtain film 6 flowing from coater head 1.

It is preferable that the setting position of shielding member 14 is at a position upstream by not more than 200 mm of the contact point of curtain film 6 with web 10. When the setting position is by more than 200 mm upstream thereof, curtain film 6 will be disturbed by the entrained air generated in the course downstream of shielding member 14 to cause a coating trouble. Even within 200 mm, the curtain film is sometimes disturbed, depending on a coating speed, etc., though there is no coating trouble, and thus approaching of the setting position of shielding member 14 to the contact point of curtain film 6 with web 6 in as allowable a range as possible from the structural viewpoint of the curtain coating apparatus can make the coating state better.

Figure 2:
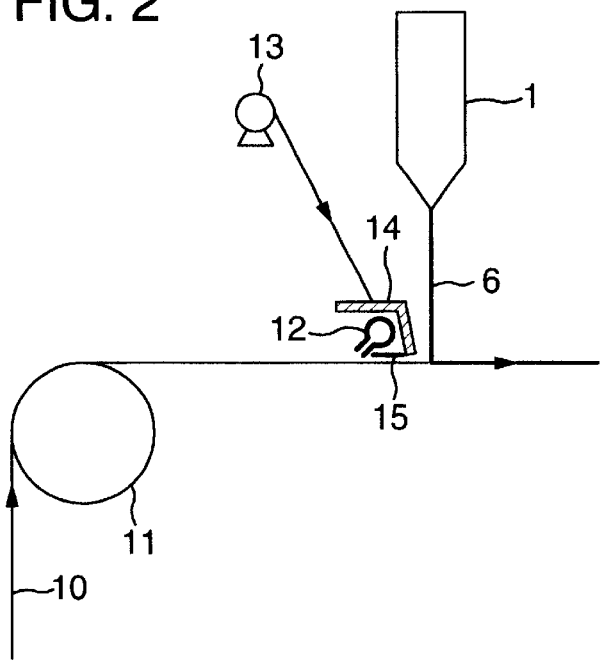
FIG. 2 is a schematic view showing another embodiment of a curtain coating apparatus according to a second aspect of the present invention.

The second aspect of the present invention will be described below, referring to FIG. 2. FIG. 2 is a schematic view showing another embodiment of a curtain coating apparatus according to the second aspect of the present invention. In FIG. 2, coater head 1 as has been already described, referring to FIG. 1, is simplified. Shielding member 14 is provided at a position upstream of and near curtain film 6 falling from coater head 1, and control member 15 is provided upon integration with shielding member 14 at the lower end. Air jet injector 12 is provided near control member 15, and air is fed thereto by air feed pump 13 connected to air jet injector 12 to eliminate the entrained air around web 10, control member 15 is provided at the lower end of shielding member 14 and in parallel to web 10, where it is desirable that control member 15 is as near to web 10 as possible, though not in contact therewith. Even after the entrained air around web 10 is eliminated by air jet injector 12 and shut off by shielding member 14, the entrained air inevitably grows on the way to curtain film 6, and thus control member 15 has an effect on controlling of such a growth.

Control member 15 is preferably in a flat plate shape broader than web 10 and is of a metallic material.

Figure 3:
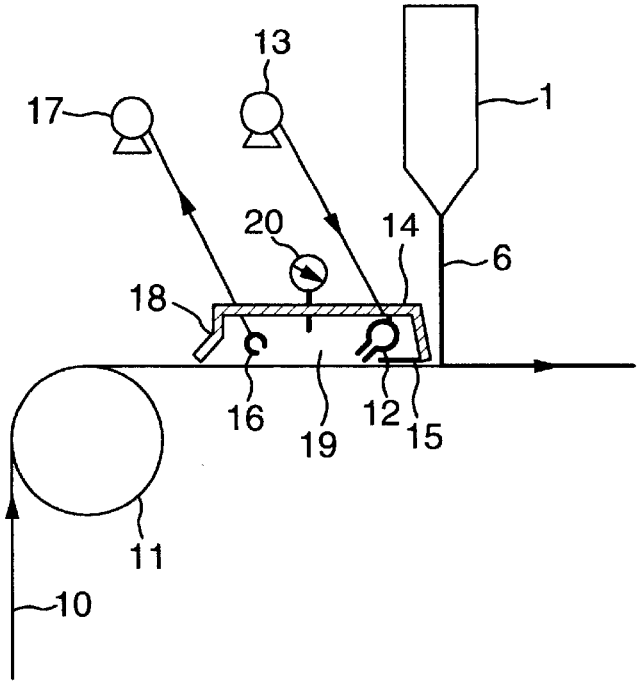
FIG. 3 is a schematic view showing other embodiment of a curtain coating apparatus according to a third aspect of the present invention.

The third aspect of the present invention will be described below, referring to FIG. 3. FIG. 3 is a schematic view showing other embodiment of a curtain coating apparatus according to the third aspect of the present invention. In FIG. 3, coater head 1 as has been already described, referring to FIG. 1, is simplified. Shielding member 14 is provided at a position upstream of and near curtain film 6 falling from coater head 1. Shielding member 14 is integrated with control member 15 at the lower end and with partition wall member 18 at the upper end to form a closed space which constitutes subatmospheric pressure zone 19. In the closed space, air jet injector 12 and air suction means 16 at a position upstream of air jet injector 12 are provided, where air jet injector 12 is to eliminate the entrained air around web 10 and air suction means 16 is to suck up the eliminated air. Air jet injector 12 and air suction means 16 are connected to air feed pump 13 for feeding air to the former and suction pump 17 for sucking up air, respectively. To control and maintain subatmospheric pressure zone 19, it is preferable to provide pressure gauge 20 in the closed space.

By making the closed space subatmospheric pressure zone 19, web 10 is elevated under the subatmospheric pressure to approach to control member 15, and the entrained air up to a position near curtain film 6 can be sucked up, while preventing growth of the entrained air on the way to curtain film 6.

Shape of partition wall member 14 as shown in FIG. 3 has been explained, but any shape can be used so far as it can maintain a closed space.

Figure 4:
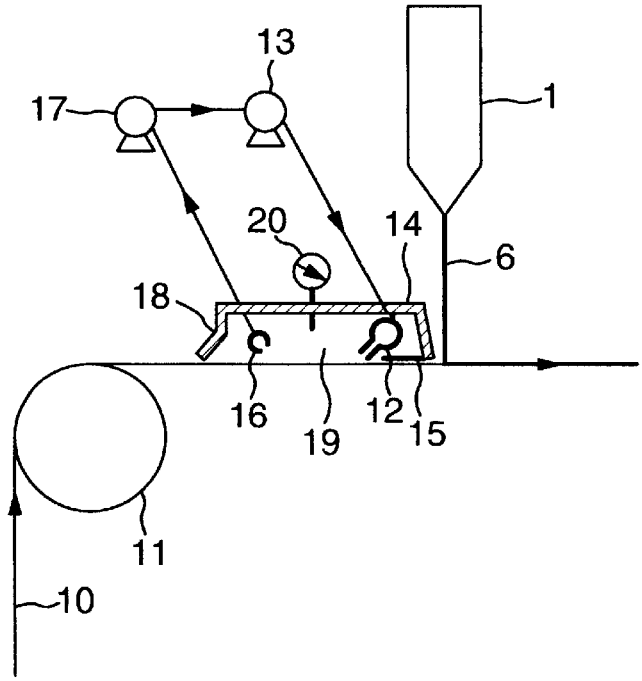
FIG. 4 is a schematic view showing another version of the curtain coating apparatus according to the third aspect of the present invention.

In the third aspect of the present invention, a more preferable embodiment will be described below, referring to FIG. 4. FIG. 4 is a schematic view showing another version of the curtain coating apparatus according to the third aspect of the present invention. In FIG. 4 air feed pump 13 and air suction pump 17 are connected to each other to form a cyclic system of using air sucked up from the closed space as an air feed source to air feed pump 13. That is, the entrained air around web 10 is eliminated by air jet injector 12, while the injected air is sucked up by air suction means 16, and the sucked up air is supplied from air suction pump 17 to air feed pump 13 as an air feed source and injected from air jet injector 12 to attain an efficient recycling.

As already mentioned before, the coater head for use in the present curtain coating apparatus includes, for example, a slide hopper type, an extrusion type, a slide-extrusion type of both mixed types, etc.

Figure 6:
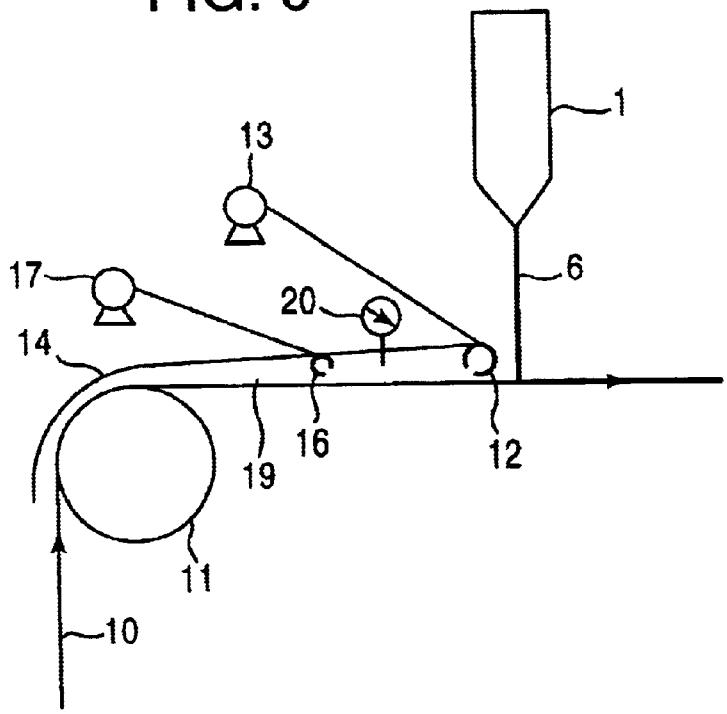
FIG. 6 is a schematic view showing a further embodiment of a curtain coating apparatus according to a fourth aspect of the present invention.

The fourth aspect of the present invention will be described below, referring to FIG. 6. FIG. 6 is a schematic view showing a further embodiment of a curtain coating apparatus according to a fourth aspect of the present invention. In FIG. 6, coater head 1 as has been already described, referring to FIG. 1, is simplified, shielding member 14 made up by integration of the shielding member and the partition wall member is extended from air jet injector 12 as has been already described, referring to FIG. 3, over the closed space as has been already described, referring to the third aspect of the present invention, up to roll 11 at the upstream position to cover roll 11, where air jet injector 12 itself is utilized as a control member, and the closed space made up by these members is made subatmospheric pressure zone 19. In the closed space, air jet injector 12 and air suction means 16 at a position downstream of the air jet injector are provided, where air jet injector 12 elimnates the entrained air around web 10, and air suction means 16 sucks up the elimianted air. Air jet injector 12 and air suction means 16 are connected to air feed pump 13 for feeding air to the former and air suction pump 17 for sucking up air, respectively. To control and maintain subatmospheric pressure zone 19, it is desirable to provide pressure gauge 20 in the closed space.

In FIG. 6, the closed space is extended up to a position near the web 10 moving direction-shifting sector of roll 11 from the vertical direction to the horizontal direction to obtain a longer distance for eliminating the entrained air around web 10. That is, it is not necessary to provide a large closed space near coater head 1, thereby reducing the volume of subatmospheric pressure zone 19. In other words, efficient elimination of the entrained air can be attained and also an effect or prevention of the entrained air from regrow the can be obtained.

Unnecessity for a larger closed space near coater head 1 also has such an effect as easy maintenance working, etc. of the coater head, edge guide, etc.

Though not shown in FIG. 6, air feed pump 13 and air suction pump 17 can be connected to each other, as shown in FIG. 4, to provide a cyclic system of utilizing the air sucked up from the closed space as an air feed source for air feed pump 13 to attain a good efficiency.

In the foregoing aspects of the present invention, it is preferable that the air jet injector is provided with an air injection pipe having a length equal to or larger than the width of the web, and one or both ends of the air injection pipe is connected to a feed pipe or feed pipes of the air feed pump. Furthermore, it is preferable that the air injection pipe is provided with air injection nozzles for injecting air at predetermined distances in the lateral direction of the web.

It is preferable that the air injection nozzles of the air injection pipe are provided at distances of 5–20 mm in the lateral direction of the web, and distances of more than 20 mm, which are outside of the preferable range, are not preferable, because an air-uninjected region is formed or distances of less than 5 mm are also not preferable, because an overlapping region of air injection is formed. Preferably, air injection nozzles provided at equal distances of 10 mm give no problem of formation of uninjected regions or overlapping regions.

Diameters of the air injection nozzles are preferably 1–3 mm. Diameters of the air injection nozzles of less than 1 mm suffer from a boring difficulty and a reduced amount of injected air, resulting in unsatisfactory elimination of the entrained air. Diameters of air injection nozzles of more than 3 mm also suffer from pressure reduction, resulting in a failure to obtain the necessary purging air for elimination of the entrained air. It is preferable for better air injection to bore air injection nozzles in a tapered-off shape with the smallest diameter of 1 mm at the innermost end.

Shapes of air injection nozzles are preferably circular or elliptical. Slit shape is not preferable, because the pressure cannot be kept uniform in the air injection pipe and the injection pressure in the lateral direction of the web is unstable.

In the description of the foregoing aspects of the present invention, air is used for injection from the air jet injector, but it is also preferable to use steam or mists in place of air, because injection of steam or mists to the web at a position upstream of the coater head is effective for easy establishment of a better coating state due to the adaptation of the web in a wet state in advance to the curtain film flowing from the coater head. Injection of steam can preheat the web, contributing to an improvement of drying efficiency.

Curtain coating process according to the present invention will be described in detail below.

In the present curtain coating process, a clearance between the air injection pipe of the air jet injector and the moving web must be taken into consideration as an important factor for eliminating the entrained air. In case of taking the air injection pipe for a control member, as already mentioned, referring to FIG. 6, the entrained air can be efficiently eliminated even in case of high speed coating by controlling the clearance between the lowest part, i.e. bottom of the air injection pipe and the moving web to not more than 6 mm. Preferable clearance is not more than 3 mm, and the lower limit is a clearance allowing no contact with the web and is more preferably 1 mm in view of vertical vibration of the web in movement.

It is not preferable on the other hand, that the clearance exceeds 6 mm, because the curtain film is disturbed by the uneliminated entrained air.

In the injection of any one of air, steam and mists through the air injection nozzles of the air injection pipe in the air jet injector according to the present curtain coating process, an injection angle to the web is set to 30°–60°. By injecting any one of air, steam and mists at such an injection angle, a curtain film can be made to fall stably without the entrained air.

As already mentioned before, the coater head for use in the present curtain coating apparatus includes, for example, a slide hopper type, an extrusion type, a slide-extrusion type of both mixed types, etc.

Description will be made below of a coating solution and a web for use in the present invention.

In the present invention, "coating solution" includes, for example, a dispersion of silver halide in an aqueous gelatin solution as a photographic emulsion, a dispersion of magnetic particles in water or an organic solvent as a coating solution for magnetic recording sheets, a dispersion of microcapsules containing a color former or a developer as a coating solution for heat-sensitive recording sheets, a coating solution for ink jet recording sheets, a dispersion of an inorganic or organic pigment as a coating solution for pigment-coated sheets, etc., which can be used unrestrictedly, so long as they are coating solutions susceptible to curtain coating, irrespective of solid concentration, etc. of the coating solutions. As to the viscosity of coating solutions, it is preferable that coating solutions have a B-type viscosity of 10–30 cps.

Web for use in the present invention includes, for example, high quality paper (wood free paper), medium quality paper, groundwood paper, machine-coated paper, coated art paper, cast-coated paper, synthetic paper, resin-coated paper, plastic films, foil-coated boards, rubber boards, fabrics of natural or synthetic fibers, etc.

PREFERRED EMBODIMENTS OF THE INVENTION

The present invention will be described in detail below, referring to Examples, where "parts" are all by weight, and "concentration" is % by weight of solid matters and "coated weight" is the one after drying, unless otherwise mentioned.

Coating solution for pressure-sensitive recording sheets for use in the following Examples and Comparative Examples was prepared in the following manner:

Microcapsule Dispersion

200 Parts of high boiling point oil (KMC-113, trademark of a product made by Kureha Chemical Industry Co., Ltd., Japan) containing 5 parts of crystal violet lactone (CVL) as dissolved therein was added to 250 parts of an aqueous 5% styrene-maleic anhydride copolymer solution (pH 5.0), followed by emulsification to obtain an average particle size of 6 $\mu$m.

Then, 20 parts of an aqueous 40% melamine-formalin precondensate solution (Sumilets resin, trademark of a product made by Sumitomo Chemical Co., Ltd., Japan) was added to the resulting emulsion and subjected to reaction at 75° C. for 2 hours, followed by pH adjustment to 9.0 with an aqueous 20% sodium hydroxide solution and then by cooling to room temperature to obtain a 40% microcapsule dispersion.

Coating Solution

The resulting microcapsule dispersion was formulated according to the following formula, followed by addition of water to adjust to concentration of solid matters to 33%, thereby obtaining a coating solution for pressure-sensitive recording sheets.

| | Parts |
|---|---|
| 40% microcapsule dispersion | 100 |
| Wheat starch (average grain size: 20 $\mu$m) | 50 |
| 48% carboxy-modified styrene-butadiene copolymer latex | 20 |

EXAMPLE 1

Pressure-sensitive recording sheet were prepared by a curtain coating apparatus shown in FIG. 1. A shielding member was provided at a position by 20 mm upstream of a contact point of a curtain film falling from a coater head with a web as a base point, and an air jet injector was provided at a position by 30 mm upstream of the base point so as to inject air in the upstream direction. High quality sheets having an areal weight of 40 g/m$^2$ were used as webs, coated with water by a blade coater provided at a further upstream position in advance, and then coated with the coating solution for pressure-sensitive recording sheets by an on-line extrusion type curtain coating apparatus at two coating speeds, i.e. 1,000 m/min. and 1,500 m/min., to obtain a coated solution weight of 3.5 g/m$^2$, thereby producing pressure-sensitive recording sheets having a coated length of 100,000 m.

EXAMPLE 2

Pressure-sensitive recording sheets were prepared by a curtain coating apparatus shown in FIG. 2. As already described, referring to FIG. 2, a control member having a length as long as the distance from the lower end of a shielding member up to the vicinity to the position of an air jet injector was fixed to the lower end of the shielding member. Pressure-sensitive recording sheets of Example 2 were prepared in the same manner as in Example 1, except for the above-mentioned structure.

EXAMPLE 3

Pressure-sensitive recording sheets were prepared by a curtain coating apparatus shown in FIG. 3. As already described, referring to FIG. 3, a closed space structure made up of integration of a shielding member, a control member and a partition wall member was provided. In the closed space, an air jet injector was provided at a position by 30 mm upstream of the shielding member, and an air suction means was provided at a position by 40 mm upstream of the air jet injector. The closed space was evacuated by the air suction means under subatmospheric pressure of −150 mm Aq. Pressure-sensitive recording sheets of Example 3 were prepared in the same manner as in Example 1, except for the above-mentioned structure and condition.

EXAMPLE 4

Pressure-sensitive recording sheets were prepared by a curtain coating apparatus shown in FIG. 4. As already described, referring to FIG. 4, the air jet injector and the air suction means of the curtain coating apparatus of FIG. 3 were connected to each other through an air piping to provide an air cyclic structure to use the air sucked up by the air suction means as an air feed source for the air jet injector. The same subatmospheric pressure condition as in Example 3 was used. Pressure-sensitive recording sheets of Example 4 were prepared in the same manner as in Example 1, except for the above-mentioned structure and condition.

Comparative Example 1

Figure 5:
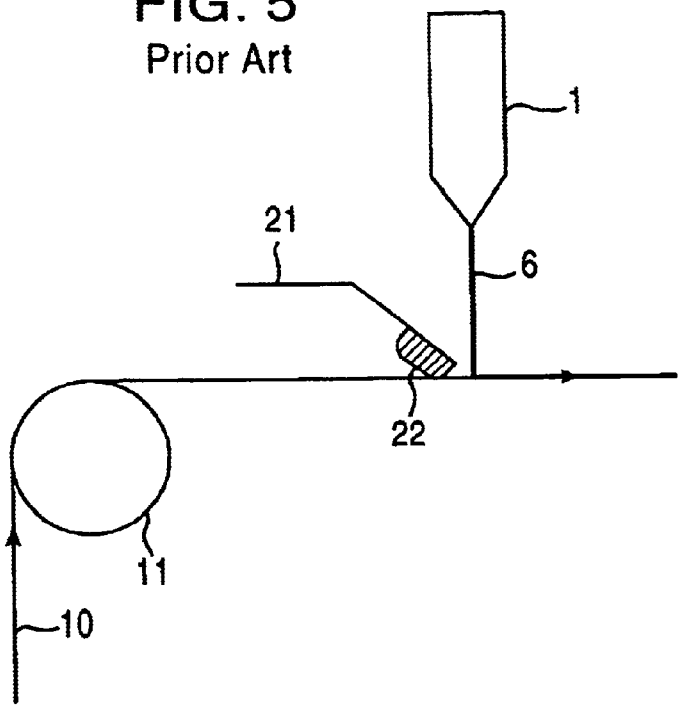
FIG. 5 Prior Art
FIG. 5 is a schematic view showing a conventional curtain coating apparatus.

Pressure-sensitive recording sheets were prepared by a curtain coating apparatus shown in FIG. 5. As already described, referring to FIG. 5, a shielding member was provided at a position by 20 mm upstream of a contact point of a curtain film falling from the coater head with a web as a base point, and a web contact member was provided at the lower part of the shielding member. Pressure-sensitive recording sheets of Comparative Example 1 were prepared in the same manner as in Example 1, except for the above-mentioned structure.

Comparative Example 2

Pressure-sensitive recording sheets of Comparative Example 2 were prepared in the same manner as in Example 1, except that the air jet injector of Example shown in FIG. 1 was not used in Comparative Example 2.

Pressure-sensitive recording sheets prepared in Examples 1 to 4 and Comparative Examples 1 and 2 were evaluated in the following evaluation procedures, and the results are given in the following Table 1.

In the evaluation of the prepared pressure-sensitive recording sheets, the state at the coating time corresponding to 1,000 m from the coating length of 99,000 up to 100,000 m was observed.

Curtain Films

Stabilization state of curtain films were visually observed and evaluated according to the following standard. Permissible levels are marked by ○ and ◎.

◎: Curtain films are very stable without any vibration.

○: Vibration of curtain films are substantially negligeble.

Δ: Slight vibration of curtain films occurs.

×: Vibration of curtain films intermittently occurs throughout full width.

Coated Surfaces

State of occurrence of coating unevenness or uncoated regions on the coated surfaces of the prepared pressure-sensitive recording sheets were visually observed, and evaluated according to the following standard. Permissible levels are marked by ○ and ◎.

TABLE 1

| | Coating speed: 1000 m/min. | | Coating speed: 1500 m/min. | |
|---|---|---|---|---|
| | Curtain film | Coated surface | Curtain film | Coated surface |
| Example 1 | ○ | ○ | ○ | ○ |
| Example 2 | ⊙ | ⊙ | ○ | ○ |
| Example 3 | ⊙ | ⊙ | ⊙ | ⊙ |
| Example 4 | ⊙ | ⊙ | ⊙ | ⊙ |
| Comp. Ex. 1 | Δ | x | x | x |
| Comp. Ex. 2 | x | x | x | x |

⊙: Neither coating unevenness nor uncoated regions are observed at all.
○: Only coating unevenness is very slightly observable, with no problem as a product.
Δ: Coating unevenness is slightly observable, with a problem as a product.
x: Both coating unevenness and uncoated regions are observable, with forbidden use as a product.

Evaluation

As is apparent from Table 1, better results were obtained at a coating speed of 1,000 m/min. in Examples 2 to 4 than in Example 1 embodying a shielding member and an air jet injector. On the other hand, in Comparative Example 1, slight vibration of curtain films occurred, though the web contact member was used at the shielding member, and consequently the coated surface was found poor. In Comparative Example 2 using only the shielding member without the air jet injector, occurrence of intermittent vibration of curtain films throughout full width was observed, and consequently the coated surface was adversely effected. At a coating speed of 1,500 m/min., vibration of curtain films occurred to a substantially negligible degree in Example 1 embodying the shielding member and the air jet injector and in Example 2 embodying the shielding member, the control member and the air jet injector, and very slight coating unevenness was observed on the coated surfaces. In Examples 3 and 4 embodying the closed space, better results were all obtained. On the other hand, in Comparative Examples 1 and 2, both vibration of curtain films and the coated surfaces were found to be a problem due to the high coating speed.

Examples 5 to 11 and Comparative Examples 3 and 4

Pressure-sensitive recording sheets were prepared by a curtain coating apparatus shown in FIG. 6. As already described, referring to FIG. 6, the closed space structure made up of integration of the shielding member, the control member, the partition wall member and the air jet injector was provided. In the closed space, the air jet injector was provided at a position by 30 mm upstream of the curtain film and the air suction means was provided at a position by 40 mm further upstream thereof. Injection nozzles of an air injection pipe in the air jet injector was provided at distances of 10 mm in the lateral direction of the web, and had circular shapes, 2 mm in nozzle diameter. Clearance between the moving web and the bottom of the air injection pipe and an injection angle of the injection nozzles to the web are given in the following Table 2. The closed space was evacuated to a subatmospheric pressure of −150 mm Aq by the air suction means. Pressure-sensitive recording sheets of Example 5 were prepared in the same manner as in Example 1, except for the above-mentioned structure and condition. In Example 11, mists were injected in place of air from the air jet injector, with other conditions being the same as in Example 8.

TABLE 2

| | Clearance from web (mm) | Injection angle (° C.) | Coating speed 1000 m/min. | | Coating speed 1600 m/min. | |
|---|---|---|---|---|---|---|
| | | | Curtain film | Coated surface | Curtain film | Coated surface |
| Ex. 5 | 1 | 30 | ⊙ | ○ | ⊙ | ○ |
| Ex. 6 | 1 | 45 | ⊙ | ⊙ | ⊙ | ⊙ |
| Ex. 7 | 1 | 60 | ○ | ○ | ○ | ○ |
| Ex. 8 | 2 | 45 | ⊙ | ⊙ | ⊙ | ○ |
| Ex. 9 | 4 | 45 | ⊙ | ⊙ | ○ | ○ |
| Ex. 10 | 6 | 45 | ○ | ○ | ○ | ○ |
| Ex. 11 | 2 | 45 | ⊙ | ⊙ | ⊙ | ⊙ |
| Comp. Ex. 3 | 1 | 70 | Δ | ○ | x | x |
| Comp. Ex. 4 | 7 | 45 | Δ | Δ | Δ | x |

Evaluation:

As is apparent from Table 2, both curtain films and coated surfaces were found better at a coating speed of 1,000 m/min. in Examples 5 to 10, among which Example 6 was particularly better at a clearance of 1 mm from the web and an injection angle of 45°. In Comparative Examples 3 and 4, slight roughness was observed on the coated surfaces, and the curtain films were partially vibrated. At a coating speed of 1,600 m/min., Example 6 showed that both curtain film and coated surface were also found particularly better, and in other Examples the curtain films and coated surfaces had no coating problems. However, at an increased injection angle as in Comparative Example 3 the injected air was carried to the curtain film to promote vibration of the curtain film. In Comparative Examples 3 and 4, pin holes due to the entrained air appeared on the entire coated surfaces. Example 11 shows injection of mists from the air jet injector in place of air under the same conditions as Example 8, where the web surface at positions upstream of the curtain film was brought into a wet state by the mists and thus the coatability of the curtain film onto the wet web surface was found better than onto the dry web surface of Example 8.

EFFECT OF THE INVENTION

The present curtain coating apparatus can produce coated products of a good quality by providing an air jet injector and a shielding member, or a shielding member integrated with a control member or a closed space made up by integration of the shielding member, the control member and a partition wall member and further provided with an air suction means therein at a position upstream of a coater head, thereby eliminating entrained air around a web at a high speed coating to stabilize a curtain film.

What is claimed is:

1. A curtain coating apparatus for applying a coating solution to a continuously moving web, which comprises an air jet injector for injecting air in the upstream direction of a web, provided at a position upstream of a contact point of a curtain film with the web and a shielding member for shutting off entrained air generated by movement of the web, provided between the contact point and the air jet injector, thereby eliminating an influence of turbulent air flow and preventing the curtain film from suction toward the air jet injector.

2. A curtain coating apparatus for applying a coating solution to a continuously moving web, which comprises an air jet injector for injecting air in the upstream direction of a web, provided at a position upstream of a contact point of a curtain film with the web, a shielding member for shutting off entrained air generated by movement of the web, provided between the contact point and the air jet injector, thereby eliminating an influence of turbulent air flow and preventing the curtain film from suction toward the air jet injector, and a control member connected to the shielding member, the control member being provided at a position near and in parallel to the web, thereby preventing the entrained air from regrowth in the course between the air jet injector and the contact point.

3. A curtain coating apparatus for applying a coating solution to a continuously moving web, which comprises an air jet injector for injecting air in the upstream direction of a web, provided at a position upstream of a contact point of a curtain film with the web, a shielding member for shutting off entrained air generated by movement of the web, provided between the contact point and the air jet injector, a control member and a partition wall member, both of which are integrated with the shielding member to form a closed space, the air jet injector and an air suction means being provided in the closed space, thereby making the closed space a subatmospheric pressure zone.

4. A curtain coating apparatus for applying a coating solution to a continuously moving web, which comprises an air jet injector for injecting air in the upstream direction of a web, provided at a position upstream of a contract point of a curtain film with the web, the air jet injector being provided with an air injection pipe with air injection nozzles for shutting off entrained air generated by movement of the web, thereby eliminating an influence of turbulent air flow and preventing the curtain film from suction toward the air jet injector, and a partition wall member covering a distance upstream of a coater head, which extends from a position at the top of the air injection pipe with the air injection nozzles to a position near the web moving direction-shifting sector of a roll from the vertical direction to the horizontal direction, thereby making the partition wall member-enclosed zone a closed space, the air jet injector and an air suction means being provided in the close space, thereby making the closed space a subatmospheric pressure zone.

5. A curtain coating apparatus according to claim 3 or 4, wherein the air jet injector is connected to the air suction means to send the air sucked up by the air suction means to the air jet injector as an air feed source.

6. A curtain coating apparatus according to any one of claims 1 to 4, wherein the air jet injector comprises an air injection pipe having a length equal to or more than the width of the web, and one end or both ends of the air injection pipe is connected to a feed pipe of an air feed pump, and the air injection pipe is provided with air injection nozzles for injecting the air at predetermined distances in the lateral direction of the web.

7. A curtain coating apparatus according to claim 6, wherein the air injection nozzles are provided at distances of 5–20 mm in the lateral direction of the web.

8. A curtain coating apparatus according to claim 6, wherein the air injection nozzles have a nozzle diameter of 1–3 mm.

9. A curtain coating apparatus according to claim 6, wherein the air injection nozzles are in a circular or elliptical shape.

10. A curtain coating apparatus according to anyone of claims 1 to 4, wherein steam or mist is injected from the air jet injector in place of air.

11. A curtain coating process using a curtain coating apparatus for applying a coating solution to a continuously moving web according to any one of claims 1 to 4, which comprises applying a coating solution to a web by an air jet injector provided at a position upstream of a contact point of a curtain film with the web and in an upstream direction, while maintaining a distance of the bottom side of an air injection pipe provided at the air jet injector and the continuously moving web at not more than 6 mm.

12. A curtain coating process using a curtain coating apparatus for applying a coating solution to a continuously moving web according to any one of claims 1 to 4, which comprises injecting one of air, steam and mists from air injection nozzles provided in an air injection pipe of an airjet injector provided at a position is upstream of a contact point of a curtain film with the web and in an upstream direction at a nozzle angle of 30°–60° to the web.

* * * * *